US005625929A

United States Patent [19]

Hattori et al.

[11] Patent Number: 5,625,929

[45] Date of Patent: May 6, 1997

[54] INTERENGAGING FASTENER MEMBER

[75] Inventors: Jiro Hattori, Atsugi; Shinji Torigoe, Sagamihara; Norihito Shibahara, Hachioji; Osamu Sawajiri, Sagamihara, all of Japan

[73] Assignee: Minnesota Mining and Manufacturing, St. Paul, Minn.

[21] Appl. No.: 285,860

[22] Filed: Aug. 4, 1994

[30] Foreign Application Priority Data

Aug. 5, 1993 [JP] Japan ..... 5-194668

[51] Int. Cl.[6] ..... A44B 18/00

[52] U.S. Cl. ..... 24/452

[58] Field of Search ..... 24/442–452, 306; 428/100

[56] References Cited

U.S. PATENT DOCUMENTS

| | | | |
|---|---|---|---|
| 3,031,730 | 5/1962 | Morin . | |
| 3,192,589 | 7/1965 | Pearson . | |
| 3,266,113 | 8/1966 | Flanagan, Jr. . | |
| 3,408,705 | 11/1968 | Kayser et al. . | |
| 3,537,946 | 11/1970 | Truax et al. . | |
| 3,808,648 | 5/1974 | Billarant et al. . | |
| 3,899,803 | 8/1975 | Brumlik . | |
| 3,899,805 | 8/1975 | McMillan . | |
| 4,169,303 | 10/1979 | Lemelson . | |
| 4,216,257 | 8/1980 | Schams et al. | 428/93 |
| 4,290,174 | 9/1981 | Kalleberg | 24/204 |
| 4,290,832 | 9/1981 | Kalleberg | 156/72 |
| 4,322,875 | 4/1982 | Brown et al. | 24/204 |
| 4,454,183 | 6/1984 | Wollman | 428/92 |
| 4,563,380 | 1/1986 | Black et al. | 428/100 |
| 4,706,914 | 11/1987 | Ground | 248/74.3 |
| 4,710,414 | 12/1987 | Northrup et al. | 428/43 |
| 4,784,890 | 11/1988 | Black | 428/100 |
| 4,814,036 | 3/1989 | Hatch . | |
| 4,894,060 | 1/1990 | Nestegard . | |
| 4,984,339 | 1/1991 | Provost et al. . | |
| 5,040,275 | 8/1991 | Eckhardt et al. | 24/447 |
| 5,077,870 | 1/1992 | Melbye et al. | 24/452 |
| 5,140,727 | 8/1992 | Dais et al. . | |
| 5,149,573 | 9/1992 | Kobe et al. . | |
| 5,179,767 | 1/1993 | Allan . | |
| 5,212,853 | 5/1993 | Kaneko | 24/452 |
| 5,235,731 | 8/1993 | Anzai et al. | 24/576 |
| 5,242,646 | 9/1993 | Torigoe et al. | 264/219 |
| 5,339,499 | 8/1994 | Kennedy et al. . | |
| 5,369,853 | 12/1994 | Okawa et al. | 24/446 |
| 5,398,387 | 3/1995 | Torigoe et al. . | |

FOREIGN PATENT DOCUMENTS

| | | | |
|---|---|---|---|
| 2264209 | 10/1975 | France | 24/452 |
| 1-238805 | 9/1989 | Japan . | |
| 4-123106 | 11/1992 | Japan . | |
| 913322 | 9/1994 | Japan . | |
| 913321 | 9/1994 | Japan . | |
| 1510558 | 5/1978 | United Kingdom . | |
| WO89/08201 | 9/1989 | WIPO . | |
| WO92/19119 | 11/1992 | WIPO . | |

*Primary Examiner*—James R. Brittain

*Attorney, Agent, or Firm*—Gary L. Griswold; Walter N. Kirn; Charles D. Levine

[57] ABSTRACT

A fastener member is disclosed, having a plurality of headed stems adjoining and projecting from a base. The headed stems are arranged in a pattern on the base, which pattern tends to increase the disengagement force in the shear direction.

5 Claims, 5 Drawing Sheets

INTERENGAGING FASTENER MEMBER

TECHNICAL FIELD

The present invention relates to an interengaging fastener member of the type including a base and a plurality of headed stems adjoining and projecting from the base.

BACKGROUND OF THE INVENTION

One type of conventional fastener includes a pair of fastener members each having a base and a plurality of arranged, headed stems adjoining and projecting from the base. The fastener members may be releasably interengaged as shown in FIGS. 5(*a*) and 5(*b*), to fasten together two objects to which the fastener members are attached.

The fastener illustrated in FIGS. 5(*a*) and 5(*b*) includes a first fastener member 1 and a second fastener member 2, each of which is molded from a polymeric material. The first and second fastener members are provided with generally flat bases 3 and 4, respectively, and a plurality of headed stems 5 arranged on the bases in a predetermined spaced relationship. Each of the headed stems includes a stem 6 projecting generally orthogonally from the base, and a head 7 connected to the end of the stem 16. The head has a diameter at at least one location that is greater than the diameter of the stem. Each head 7 has a generally flat locking surface 8 adjacent the stem 6 and extending radially from the periphery of the stem 6, and an apex 9 at an opposite side of the locking surface 8 from the stem 6.

To interengage the fastener, the first fastener member 1 and the second fastener member 2 are opposed as shown in FIG. 5(*a*), so that the headed stems 5 thereof confront each other while the bases are substantially parallel to each other. When a predetermined pressure is applied to the respective bases, the heads 7 of one fastener member come into contact with and slide against, at the apexes 9 thereof, the heads 7 of the other fastener member. The stems of both fastener members resiliently deflect to allow the heads to enter the space between the adjacent stems 6 of the other fastener member, as shown in FIG. 5(*b*). Thus, the headed stems 5 of one fastener member are engaged at their locking surfaces 8 with the locking surfaces 8 of the other fastener member, and the first and second fastener members are thereby interengaged with each other.

In an interengaging fastener member of the type described above, the headed stems are typically arranged in a regular array of rows and columns. FIG. 6 shows a standard arrangement of headed stems E, in which the headed stems are linearly arranged along mutually perpendicular axes (labeled X and Y), and along an inclined direction (shown by a broken line) that intersects the perpendicular axes. However, regular arrangements of headed stems may allow fastener members to move relative to each other in a direction parallel to the rows or columns of the fastener members, also referred to as the shear direction. Thus, although the fastener exhibits a relatively large tensile disengagement force, it may display a low shear disengagement force, which may be undesirable.

The reason why a sufficient retaining force cannot be exerted against a force acting in the shear direction is that the headed stems are regularly arranged in columns and rows. If the headed stems are irregularly arranged, it is difficult to provide desired spaces between beaded elements when manufacturing the fastener members. In addition, an irregular arrangement may not be accurately reproducible, resulting in fluctuations in the engagement and disengagement performance of the fastener members.

In view of the foregoing, it would be desirable to provide a fastener that exhibits a satisfactory disengagement force and shear force, using headed stems in a non-random arrangement.

SUMMARY OF THE INVENTION

To accomplish the above object, the present invention provides an interengaging fastener member comprising a base, and a plurality of headed stems arranged on the base in a predetermined spaced relationship. Each of the headed stems includes a stem projecting from the base, and a head connected to a distal end of the stem, wherein the headed stems include a first set of headed stems arranged at positions defining vertexes of at least one generally regular polygonal pattern on the base. Each pattern has a center point, and at least one second headed stem located within each of the polygonal patterns and arranged at a position offset from the center point.

Each polygonal pattern may be a generally regular hexagonal pattern. It is preferred that the second headed stems are arranged at positions offset from the center points of the polygonal patterns in different directions in a pair of adjacent polygonal patterns. It is also preferred that the base and the headed stems are integrally molded by an injection molding process using a destructible stem mold.

The present invention also provides an interengaging fastener member comprising a base, and a plurality of headed stems arranged on the base in a predetermined spaced relationship. Each of the headed stems includes a stem projecting from the base, and a head connected to a distal end of the stem. The headed stems are arranged at positions defining a plurality of concentric circular patterns on a surface of the base.

The headed stems may be arranged with substantially regular pitches in a circumferential direction in each of the concentric circular patterns. It is preferred that the headed stems on the concentric circular patterns are not linearly aligned in radial directions. The headed stems may be arranged on the surface of the base with substantially regular pitches. It is also preferred that the base and the headed stems are integrally molded by an injection molding process using a destructible stem mold.

The present invention further provides an interengaging fastener member comprising a base, and a plurality of headed stems arranged on the base in a predetermined spaced relationship, each of the headed stems including a stem projecting from the base, and a head connected to a distal end of the stem, wherein the headed stems include a first row of headed stems arranged in a straight line across the base, and a second row of headed stems adjacent and substantially parallel to the first row, the second row of headed stems having a sinusoidal pattern relative to the first row. In this case, the fastener member may comprise alternating first rows of headed stems and second rows of headed stems.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE INVENTION

Figure 1A:
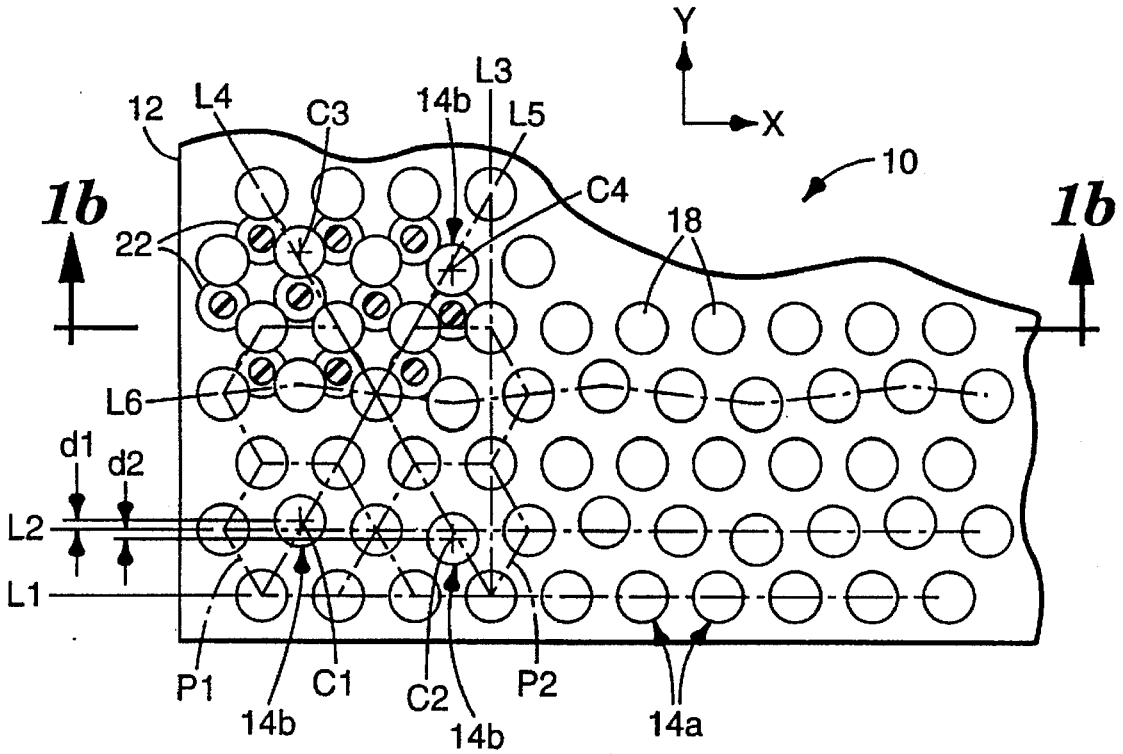
FIG. 1(*a*) is a partial plan view, and FIG. 1(*b*) is a sectional view along line I—I of FIG. 1(*a*), of an interengaging fastener member according to an embodiment of the present invention.
Figure 1B:
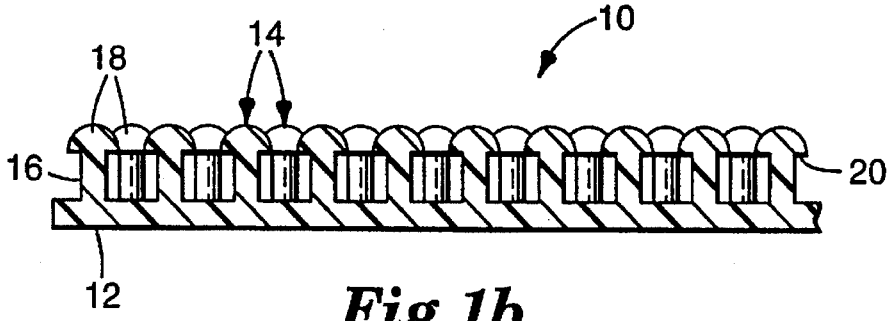

Referring to the drawings, FIG. 1 shows a interengaging fastener member 10 according to the embodiment of the present invention. The interengaging fastener member 10 is preferably made from polymeric materials as a unitary body, and includes a generally flat base 12 and a plurality of headed stems 14 arranged on the base 12 in a predetermined spaced relationship. Each of the headed stems 14 has a stem 16 projecting generally orthogonally from the surface of the base 12, and a head 18 formed at the end of the stem 16. The head has a diameter at at least one location that is greater than the diameter of the stem. The head is generally centered on the stem, although other offset positions are also possible.

In FIG. 1(*a*), the headed stems 14 of the fastener member 10 include first headed stems **14*a* arranged at positions defining vertexes of generally regular hexagonal patterns (shown by broken lines) on the surface of the base 12, and second headed stems 14*b*. At least one of the second headed stems 14*b* is arranged within the hexagonal pattern, at a position adjacent to and offset from the center point of the hexagonal pattern. The generally regular hexagonal patterns formed of the first headed stems 14*a* are continuously arranged on the base 12 with a common side or a common vertex between adjacent patterns. The term "generally regular polygonal" is used in this specification to represent any polygonal shape, including not only a regular polygonal shape as strictly and geometrically defined, but also a polygonal shape slightly deformed from the regular polygonal shape while keeping the axial symmetry thereof. The positions of the headed stems 14 are represented with the center axes of the stems 16 and heads 18**.

The first headed stems **14*a* are linearly aligned on the base 12 in accordance with the regular arrangement of the generally regular hexagonal patterns, along straight broken lines L1 and L2 (extending in a direction X), a straight broken line L3 (extending in a direction Y) orthogonal to the lines L1, L2, and straight broken lines L4 and L5 obliquely to the lines L1, L2, and L3. These broken lines L1, L2, L3, L4, and L5 pass through the center of the heads 18 of the first headed stems 14*a***.

As shown in, for example, a lower left pattern Pl (involving six first headed stems **14*a* and one second headed stem 14*b*), the second headed stem 14*b* is arranged at a position offset in the direction Y by a distance d1 from the broken line L2 showing the array of the first headed stems 14*a* (the center of the second headed stem 14*b* is indicated by C1). In a pattern P2 adjacent the pattern P1, the second headed stem 14*b* is arranged at a position offset in the direction Y by a distance d2, preferably opposite to the second headed stem 14*b* of the pattern P1, from the broken line L2 (the center of the second headed stem 14*b* is indicated by C2). To facilitate manufacturing of the interengaging fastener member 10, it is preferred that the distances d1 and d2 are equal to each other. Such patterns P1 and P2 are continuously formed in the directions X and Y on the base 12**, thus defining the arrangement of the headed stems.

Due to the arrangement described above, the disengagement force in the shear direction is increased, because the second headed stems **14*b* are located between the regularly arranged first headed stems 14*a*, to change the linear arrays (along the broken line L2, for example) thereof into nonlinear arrays (along a broken line L6, for example). Consequently, the second headed stems 14*b* attenuate the linear orientation of the entire arrangement of the headed stems 14 on the base 12, thereby providing the interengaging fastener member 10 with an increased disengagement force in the shear direction. This function will be described below in conjunction with headed stems of the opposed fastener member, as shown at 22** in FIG. 1(*a*).

When the headed stems of the opposed fastener member are arranged in the same patterns as those of the fastener member 10, each head 22 of the opposed fastener member is inserted into a space surrounded by the heads 18 of three headed stems 14 of the fastener member 10. In this position, if all of the headed stems of both fastener members are linearly arrayed in the direction X, the heads of the headed stems of one fastener member will easily move in the direction X through the stems of the headed stems of the other fastener member. Namely, a fastener having such fastener members cannot exert a sufficient engagement-retaining force against a shearing force acting in the direction x on the fastener members on, the contrary, in the fastener member 10 according to the present invention, the second headed stems **14*b*** located at positions offset in the direction Y from the centers of the generally regular hexagonal patterns prevent the opposed headed stems from sliding in the direction X, whereby the disengagement force in the shear direction is exerted.

At the same time, as shown by the centers C1, C2, C3 and C4 in FIG. 1(*a*), the second headed stems **14*b* change the linear arrays in the inclined directions (along the broken lines L4 and L5, for example) of the first headed stems 14*a* into nonlinear arrays. Consequently, the fastener member 10 displays an increased disengagement force in the inclined shear directions, because the second headed stems 14*b* thereof prevent the opposed headed stems from sliding in the inclined directions. It may be understood that the headed stems 14 of the fastener member 10** are arranged so as to exert a sufficient disengagement force against a shearing force acting in the direction Y.

From another viewpoint, the arrangement of the headed stems 14 shown in FIG. 1 can be also regarded as an arrangement of alternating rows. The rows include a first row of headed stems arranged in a straight line (along the broken line L2, for example) across the base, and a second row of headed stems adjacent and substantially parallel to the first row, the second row of headed stems having a sinusoidal pattern (along the broken line L6, for example) relative to the first row. In this case, the first and second rows of headed stems are not necessary alternately arranged, and may have any suitable set of straight and sinusoidal rows.

Figure 2A:
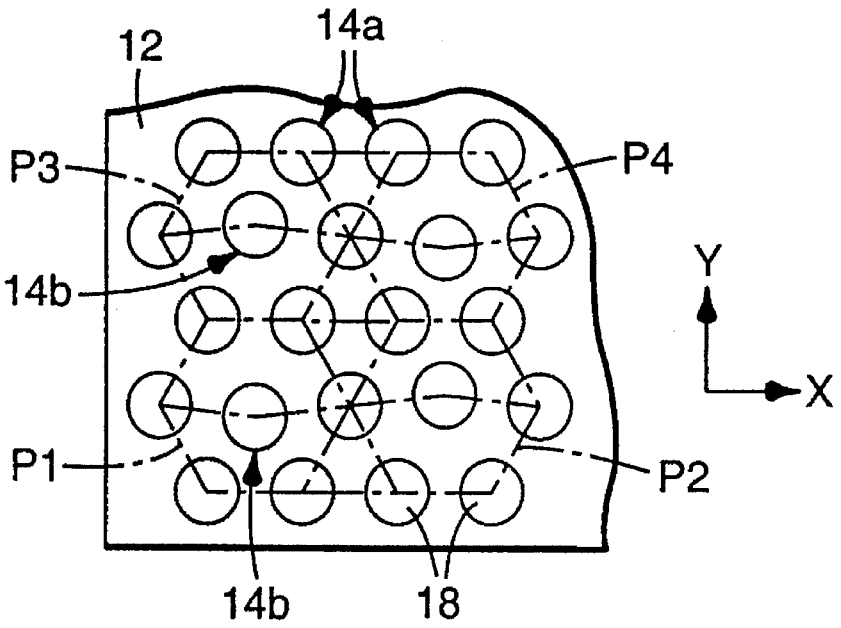
FIGS. 2(*a*) and 2(*b*) are schematic plan views of headed stems arranged in accordance with the present invention.
Figure 2B:
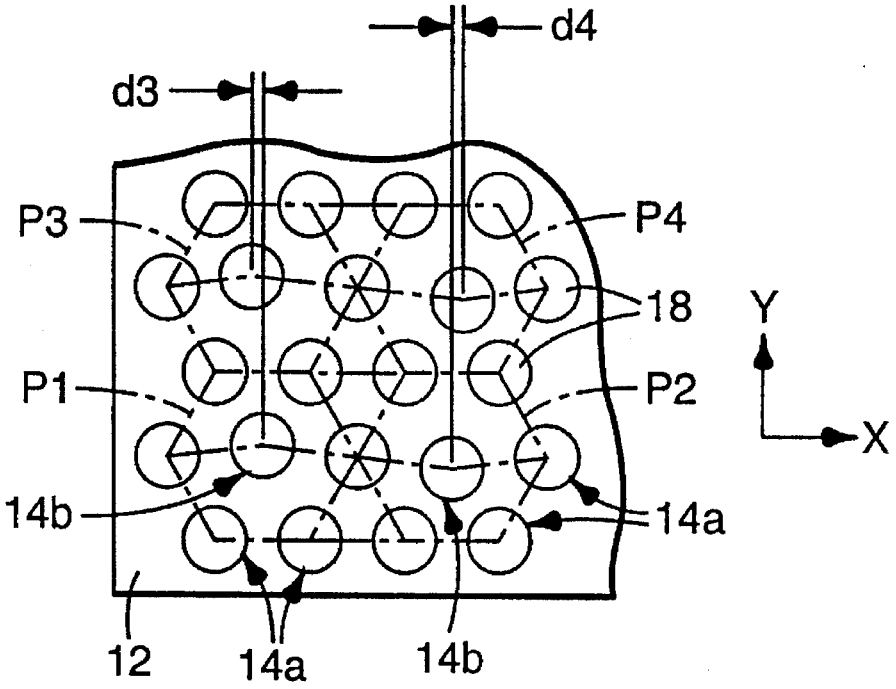

FIG. 2 shows modifications of arrangements of the headed stems 14, which employ the generally regular hexagonal pattern of FIG. 1 as a basic pattern. FIG. 2(*a*) shows an arrangement of the headed stems 14, which includes patterns P1, P2 and patterns P3, P4 joined to the patterns P1, P2 in the direction Y. The second headed stems **14*b* in the patterns P3, P4 are shifted opposite to those in the patterns P1, P2**, respectively. FIG. 2(*b*) shows an arrangement of the headed stems 14, which includes patterns P1, P2 and patterns P3, P4 joined to the patterns P1, P2 in the direction Y, but the second headed stems **14*b* in the patterns P3, P4 are further shifted in the opposed X direction by distances d3**, d4, regarding those in the patterns P1, P2, respectively. Each of these modifications can enable the fastener to exhibit a disengagement force against shearing forces acting in the direction X and in the inclined directions.

Figure 3A:
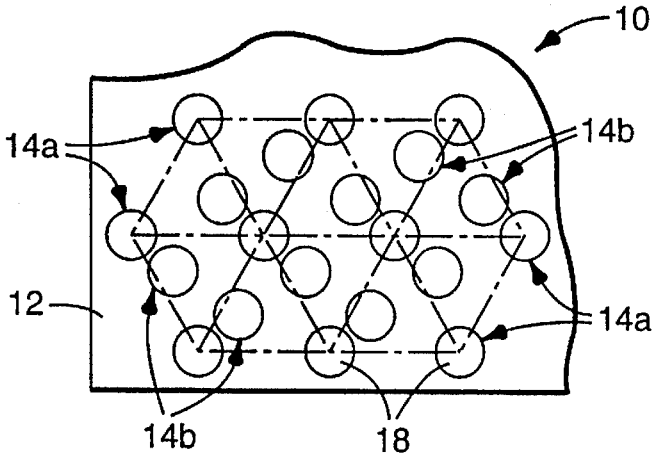
FIGS. 3(*a*), 3(*b*), and 3(*c*) are schematic plan views of headed stems arranged in accordance with the present invention.
Figure 3B:
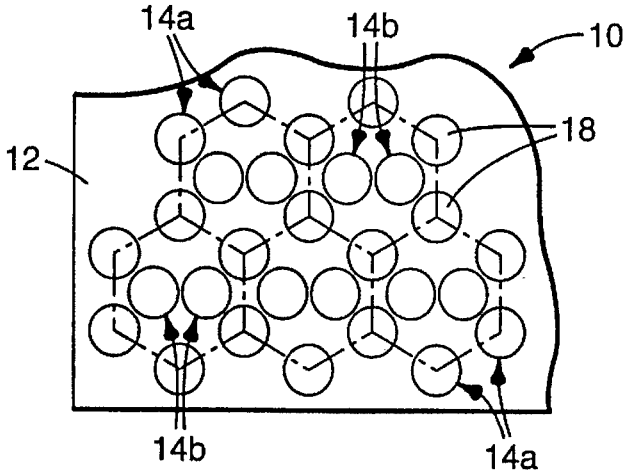
Figure 3C:
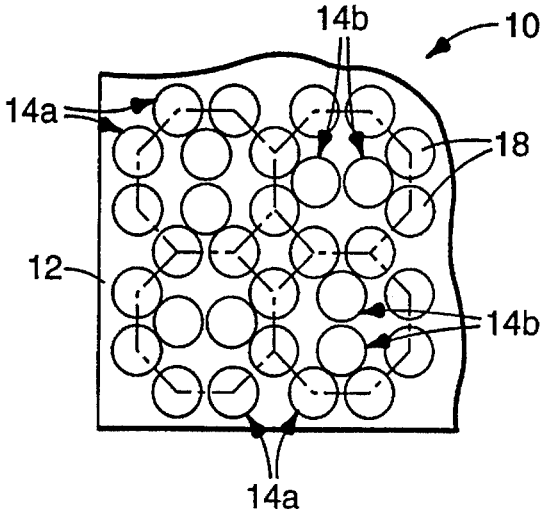

In the embodiments described above, the basic pattern for arranging the headed stems of the interengaging fastener member is a generally regular hexagonal pattern, but the present invention is not restricted to such a construction. The present invention may provide various constructions, wherein, for example, another polygonal pattern (octagonal, for example) is the basic pattern for arranging the first headed stems, and at least one second headed stem is located within the polygonal pattern and arranged at a position adjacent to and offset from the center point of the polygonal pattern. By way of example, FIG. 3(*a*) shows a construction which includes first headed stems 14*a* arranged at vertexes of regular triangular patterns (shown by broken lines), and second headed stems 14*b*, each being arranged at a position offset from the center of each triangle pattern. FIG. 3(*b*) shows a construction which includes first headed stems 14*a* arranged at vertexes of regular hexagonal patterns (shown by broken lines), and second headed stems 14*b*, each being arranged at two positions offset from the center of each hexagonal pattern. FIG. 3(*c*) shows a construction which includes first headed stems 14*a* arranged at vertexes of regular octagonal patterns (shown by broken lines), and second headed stems 14*b*, each being arranged at two positions offset from the center of each octagonal pattern.

Figure 4:
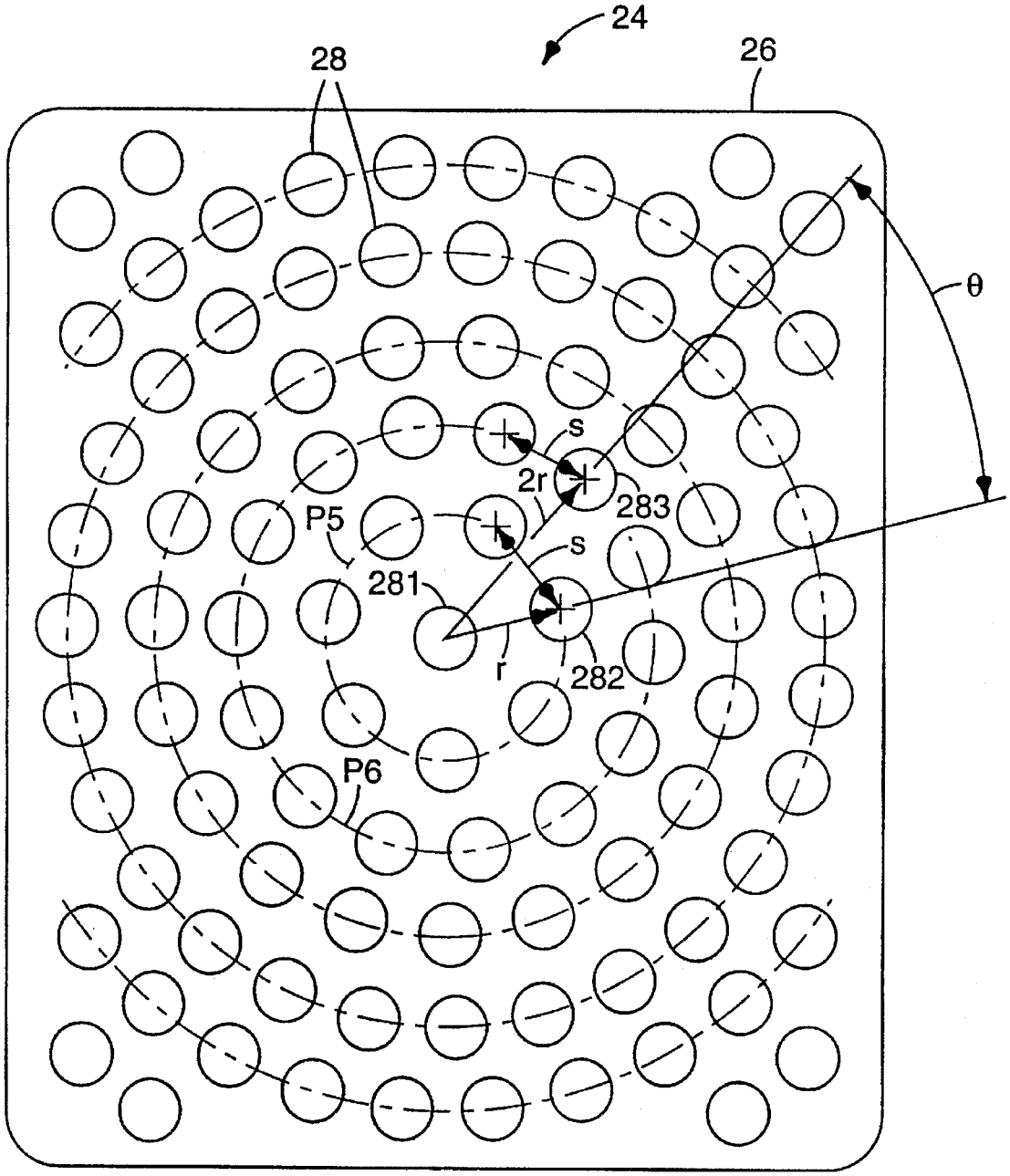
FIG. 4 is a plan view of a fastener member according to another embodiment of the present invention.
Figure 5A:
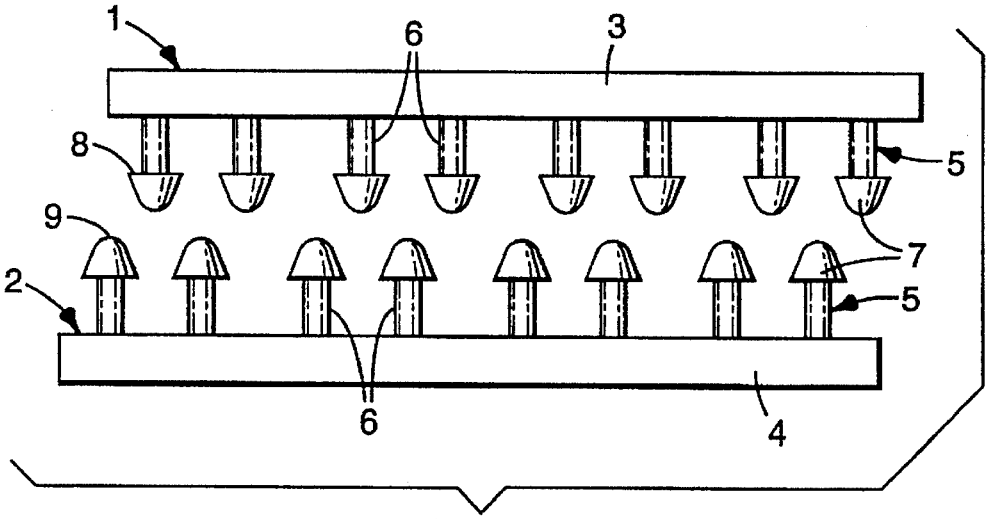
Fig. 5a PRIOR ART
FIGS. 5(*a*), 5(*b*) and 6 show conventional fastener configurations.
Figure 5B:
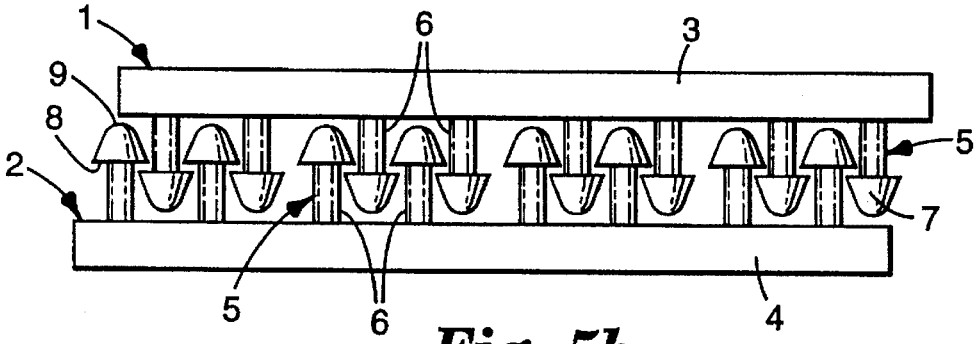
Fig. 5b PRIOR ART
Figure 6:
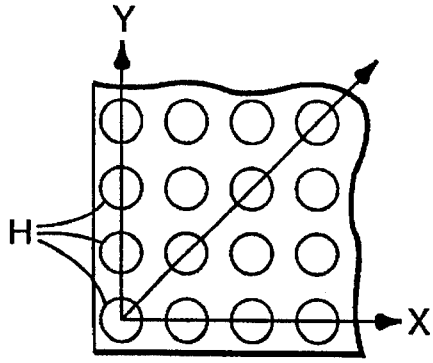
Fig. 6 PRIOR ART

FIG. 4 shows an interengaging fastener member 24 according to another embodiment of the present invention. The fastener member 24 includes a generally flat base 26, and a plurality of headed stems 28 arranged on the base 26 in a predetermined spaced relationship. The headed stems 28 have the similar shape as the headed stems 14 of the embodiment of FIG. 1. The position of each headed stem 28 is indicated with the position of the center axis of the head thereof. The headed stems 28 of the interengaging fastener member 24 are arranged in concentric circular patterns (indicated with broken lines), at the center of which one headed stem 28 is arranged, on the surface of the base 26. The differences between the radii of adjacent concentric circular patterns are preferably generally equal in the entire arrangement of the headed stems 28. It is preferred that the headed stems 28 are arranged with substantially regular pitches in the circumferential direction in each concentric circular pattern. Further, the headed stems 28 are preferably not linearly aligned in radial directions in the entire arrangement thereof.

The arrangement of the headed stems 28 shown in FIG. 3 can be obtained by the following methodology. First, the position of a central headed stem 281, and a space s between the headed stems 28 on the base 26 are determined, and thus an innermost pattern P5 with a given radius r (r is nearly equal to s), of which center is defined by the headed stem 281, is obtained. Then, the position of a reference beaded element 282 in the pattern P5 is determined, and a plurality of headed stems 28 are arranged along the pattern P5 with generally regular intervals "s". Next, a pattern P6 with a radius 2r, of which center is defined by the headed stem 281, is obtained. A reference headed stem 283 is located in the pattern P6 at a position shifted in a given angles from the headed stem 282 of the pattern P5, and, starting from the headed stem 283, a plurality of headed stems 28 are arranged along the pattern P6 with generally regular intervals "s". These procedures are repeated for all concentric circular patterns, so as to construct the fastener member 24 with the headed stems 28 which are arranged on the base with substantially regular pitches as a whole, as shown in FIG. 4. According to the foregoing arrangement, linear arrays are substantially eliminated from the entire arrangement of the headed stems 28. Therefore, similar to the fastener member 10 of FIG. 1, the fastener member 24 displays an increased disengagement force against a force acting in a shearing direction on the fastener member engaged with another fastener member.

In the fastener members of the above embodiments, the arrangements of the headed stems 14, 28 are determined with a basic pattern which is defined by regular hexagons mutually joined while a side or a vertex thereof being held in common, or by concentric circles. The headed stem arrangements are readily designed by computer aided design (CAD), similar to the conventional fastener members having regularly arranged headed stems, and the headed stems can be machined by a numerically controlled (NC) machine tool. In the above embodiments, a space between the adjacent headed stems 14, 28 is preferably between 1.0 mm and 3.0 mm.

The interengaging fastener member according to the present invention may have any dimensions and shapes. In the above embodiments, for example, the base 12, 26 may have dimensions and shapes which enables the base to firmly hold a plurality of headed stems. The thickness of the base may be in the range of 0.5 mm to 5.0 mm. The headed stems 14, 28 may also have any dimensions and shapes. For example, the stem 16 may have a cylindrical, prismatic, or frustoconical shape. The stem may be connected to the base with a radiused surface. Each headed stem may have a plurality of stems. The head 18 may have not only the hemispherical shape shown in the drawing, but also a bullet shape or a spherical shape. The head 18 may have recesses or grooves for reducing an engagement force required for interengagement.

The interengaging fastener member according to the present invention may be made from different materials. For example, the base 12, 26 in the above embodiments may be made of polymeric material, such as polyamide resin, polyester resin, or polypropylene resin. Particularly, polyamide resin is one of the more suitable material because of excellent thermal durability, mechanical strength, and injection-molding aptitude. As is well known, the bending elastic modulus of a material can be modified or changed by adding plasticizer or reinforcing member. When the base 12, 26 is formed from nonwoven or woven fabrics, the interengaging fastener member can be provided with proper flexibility. When the base is made from electrically conductive material, an antistatic effect can be obtained.

The headed stems 14, 28 may be made from the same polymeric material as that of the base 12, 26. In particular, the heads 18 is preferably made of material having a bending modulus of elasticity of between $10^3$ kgf/cm$^2$ and $10^5$ kgf/cm$^2$ according to a measurement based on ASTM testing method D790. Also, the base 12 (26) and the stems 16 of the headed stems 14 (28) may be made of a high-strength material different from the material of the heads 18, for improving the durability.

The interengaging fastener member according to the present invention may be formed by various methods. It is advantageous to integrally mold the base and the headed stems by an injection molding process using a destructible stem mold, to easily form the headed stems having unique shapes. This molding process is described in detail in U.S. Pat. No. 5,242,646 (Torigoe et al.), the contents of which is incorporated herein by reference. First, a base mold for molding the base of the interengaging fastener member, a stem mold for molding the stems of the headed stems, and a head mold for molding the heads of headed stems are prepared. The base mold is a permanent mold which can be released from the molded interengaging fastener member without destruction thereof, and has a cavity corresponding to the base. The stem mold is a destructible mold which is destructively removed from the molded interengaging fastener member in a manner as described below, and has a plurality of cavities corresponding to the stems. The head mold is a permanent mold which can be released from the molded interengaging fastener member without destruction thereof, and has a plurality of cavities corresponding to the heads.

The stem mold is durable as a core used in the injection molding process for forming the interengaging fastener member, and can be destructibly removed from the molded fastener member by various means after the fastener member has been molded. For example, the stem mold may be removed from the periphery of the stems by various mechanical or chemical methods, such as dissolving with a solvent (water or alcohol, for example), melting, disintegrating, shattering (by ultrasonic waves, for example), or cutting, without damaging the interengaging fastener member. In a preferred embodiment, the stem mold is made of a water-soluble material. In this case, the stem mold can be removed from the fastener member by immersing the mold in cold or hot water and vibrating the mold.

The stem mold is fixedly arranged between the base mold and the head mold. The cavity of the base mold, the cavities of the stem mold, and the cavities of the head mold are connected with each other so that a fluid can flow therethrough. A molten polymeric or other material is flowed into the cavities through an inlet passageway provided in one of the molds. The molten material flowed into the cavity of the base mold fills the cavity to form the base, fills the cavities of the stem mold to form the stems, and fills the cavities of the head mold to form the heads. Thereafter, as the molten polymeric material is solidified, the interengaging fastener member is integrally molded, which has the headed stems 14 connected at one ends to the base and at the other end to the heads. Once the interengaging fastener member has been molded, the base and head molds are removed from the molded fastener member, while leaving the stem mold. Then, the stem mold is destructively removed from the stems of the headed stems by various means described above. Thus, the interengaging fastener member is completed.

To clarify the retaining force improving effect of the interengaging fastener members against a shearing force, according to the above embodiments, the following experiment was performed. The shear forces required to disengage the engaged headed stems of a pair of interengaging fastener members from each other were measured by an Autograph type tester, while moving both fastener members in opposite lateral directions (to provide shear) at a stretching speed of 100 mm/min. These experiments were carried out on various fasteners having a pair of like fastener members, each of which has various arrangements of headed stems. Each headed stem of the respective interengaging fastener members had a head of 1.8 mm in maximum projected diameter. The interengaging fastener members were made from polyamide resin having a bending elastic modulus of 40,000 kg/cm$^2$. The following table shows the results of the experiments.

TABLE 1

| No. | Basic pattern | Stem pitch (mm) | dl d2 (mm) | Shearing force (kgf/25 × 25 mm$^2$) X | Y | inclined |
|---|---|---|---|---|---|---|
| 1 | matrix | — | — | 8 | 4 | 12 |
| 2 | hexagon | 1.5 | 0 | 8 | 11 | 8 |
| 3 | hexagon | 1.5 | 0.18 | 16 | 16 | 16 |
| 4 | hexagon | 2.0 | 0.18 | 15 | 16 | 16 |
| 5 | circle | 1.5 | — | 32 | 31 | 32 |
| 6 | circle | 2.0 | — | 30 | 30 | 30 |

Note that in experiments 2 through 4, the stem pitch is represented by a distance between the centers of two heads which are arranged at adjacent vertexes in one hexagonal pattern, and d1=d2. In Nos. 5 and 6, the stem pitch is represented by a distance between the centers of adjacent two heads which are arranged along one concentric circular pattern.

As is apparent from the above descriptions, according to the present invention, a fastener having a pair of interengaging fastener members with headed stems can exert a sufficient disengagement force against a force acting in a shearing direction on the fastener members, by arranging the headed stems at nearly irregular positions using regular basic patterns, without causing difficulties regarding a designing or processing by automatic machines. The interengaging fastener members according to the present invention, therefore, improve the performance of the fastener.

The present invention has now been described with reference to several embodiments thereof. It will be apparent to those skilled in the art that many changes can be made in the embodiments described without departing from the scope of the invention. Thus, the scope of the present invention should not be limited to the structures described herein, but rather by the structures described by the language of the claims, and the equivalents of those structures.

We claim:

1. An interengaging fastener member comprising a base and a plurality of headed stems arranged on the base, each of the headed stems including a stem projecting from the base, and a head connected to a distal end of the stem, the arrangement of headed stems comprising:

a first set of headed stems arranged in a predetermined spaced relationship, adjacent headed stems in the first set being separated by a first distance, a plurality of headed stems from the first set defining at least two adjacent polygonal patterns; and a second set of headed stems not in the first set of headed stems, headed stems in the second set being separated from adjacent headed stems in the first set by a distance not equal to the first distance, at least one of the headed stems in the second set located within each of the polygonal patterns.

2. The interengaging fastener member of claim 1, wherein each polygonal pattern is a generally regular hexagonal pattern.

3. The integrating fastener member of claim 1, wherein the base and the headed stems are integrally molded by an injection molding process using a destructible stem mold.

4. An interengaging fastener member comprising a base, and a plurality of headed stems arranged on the base in a predetermined spaced relationship, each of the headed stems including a stem projecting from the base, and a head connected to a distal end of the stem, wherein the headed stems include:

(a) a plurality of first rows of headed stems arranged in a straight line across the base; and (b) a plurality of second rows of headed stems alternating with the plurality of first rows of headed stems adjacent and substantially parallel to the first rows, the second rows of headed stems having a sinusoidal pattern relative to the first rows.

5. The interengaging fastener member of claim 4, wherein the fastener member comprises alternating first rows of headed stems and second rows of headed stems.

* * * * *